US011035118B2

(12) United States Patent
Gamarekian et al.

(10) Patent No.: US 11,035,118 B2
(45) Date of Patent: Jun. 15, 2021

(54) CONNECTOR CLIPS FOR CONSTRUCTION BLOCKS AND RETAINING WALL BLOCK SYSTEM AND METHOD

(71) Applicant: Cambridge Pavers, Inc., Lyndhurst, NJ (US)

(72) Inventors: Charles H. Gamarekian, Lyndhurst, NJ (US); Christopher S. Gamarekian, Lyndhurst, NJ (US); Nelson K. Walling, Miami, FL (US); Jaoquim L. Callahan, Rutherford, NJ (US)

(73) Assignee: Cambridge Pavers, Inc., Lyndhurst, NJ (US)

( * ) Notice: Subject to any disclaimer, the term of this patent is extended or adjusted under 35 U.S.C. 154(b) by 0 days.

(21) Appl. No.: 16/549,909

(22) Filed: Aug. 23, 2019

(65) Prior Publication Data

US 2021/0054621 A1 Feb. 25, 2021

Related U.S. Application Data

(60) Provisional application No. 62/799,909, filed on Feb. 1, 2019.

(51) Int. Cl.
*E04B 2/34* (2006.01)
*E04B 2/02* (2006.01)

(52) U.S. Cl.
CPC ..... *E04B 2/34* (2013.01); *E04B 2002/0243* (2013.01)

(58) Field of Classification Search
CPC ..... E04B 2002/0252; E04B 2002/0243; E04B 2002/0245; E04B 2002/0215; E04B 2/32; E04B 2/34; E02D 29/025; E04F 15/02016; E04F 2201/05; E04F 2201/0547
USPC ..... 52/586.2
See application file for complete search history.

(56) References Cited

U.S. PATENT DOCUMENTS 2,711,096 A 6/1955 Rouzaud
3,232,395 A * 2/1966 La Barge ..... B25B 27/0092 52/586.2
3,286,425 A * 11/1966 Brown ..... E04B 1/6815 52/396.06
4,454,699 A 6/1984 Strobl
5,528,873 A * 6/1996 Correia ..... E02D 29/0266 405/284
5,540,525 A * 7/1996 Miller ..... E02D 29/0225 405/284
5,595,460 A * 1/1997 Miller ..... E02D 29/025 405/284
D406,358 S 3/1999 Risi
(Continued)

FOREIGN PATENT DOCUMENTS

DE 19633707 A1 * 2/1998 ..... E04B 2/18

*Primary Examiner* — Christine T Cajilig
(74) *Attorney, Agent, or Firm* — Richard Malagiere, Esq.

(57) ABSTRACT

A connector clip to secure mating construction blocks and geogrid by fitting into communicating slots in the construction blocks comprising an elongate generally rectangular member with a top face, bottom face and side walls. Each side wall having a top portion and bottom portion divided at the center point of the side wall. The distance between the center point of each side wall is equal to or slightly larger than the width of the communicating slots in the construction blocks into which it is to be inserted. Each side wall bottom portion having sections of material removed creating griping flanges.

8 Claims, 7 Drawing Sheets

(56) References Cited

U.S. PATENT DOCUMENTS

Figure 1:
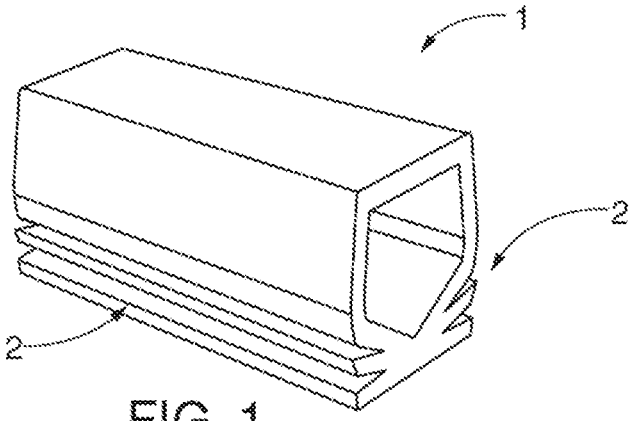

| | | | | |
|---|---|---|---|---|
| 5,984,589 | A * | 11/1999 | Ciccarello | E02D 29/0266 405/262 |
| 6,035,599 | A | 3/2000 | Sonnentag | |
| 6,149,352 | A | 11/2000 | MacDonald | |
| 6,827,527 | B2 * | 12/2004 | Conkel | E02D 29/025 405/262 |
| 7,406,804 | B2 * | 8/2008 | Den Daas | E04B 1/4178 405/286 |
| 7,597,504 | B2 | 10/2009 | McNear | |
| 8,622,659 | B2 | 1/2014 | Friederichs et al. | |
| 10,794,064 | B2 * | 10/2020 | Tuynman | F16J 15/025 |
| 2002/0189190 | A1 * | 12/2002 | Charmat | B44C 1/105 52/586.2 |
| 2018/0209143 | A1 * | 7/2018 | Rodenburgh | E04F 13/0835 |

* cited by examiner

CONNECTOR CLIPS FOR CONSTRUCTION BLOCKS AND RETAINING WALL BLOCK SYSTEM AND METHOD

PRIORITY

This application claims priority to provisional application 62/799,909 filed on Feb. 1, 2019.

BACKGROUND OF INVENTION

The present invention relates to construction blocks and in particular concrete blocks used for the construction of retaining walls. Disclosed herein is a connector clip designed to fit within receiving recesses disposed in the opposed top and bottom surfaces of construction blocks as these blocks are stacked up in the construction of a wall having a straight or inclined front face. The Applicant discloses a connector clip, an anchoring/alignment system comprised of the connector clips and the construction blocks with receiving recesses that allow the construction blocks to be assembled using the disclosed connector clips and a method of assembling construction blocks in a vertical or setback arrangement employing the disclosed connector clips and construction blocks with receiving recesses. The disclosed device, system and method ensure a mechanical connection between the construction blocks in one preferred embodiment and between the construction blocks while also anchoring the geogrid mesh secured to the surrounding ground. Further, the disclosed device, system and method work to ensure that the construction blocks are aligned during installation and stay in place as the wall is erected.

The prior art discloses blocks with parallel and offset recesses to accommodate stacking in a standard upright or an offset position in the construction of a wall. U.S. Pat. No. 5,528,873 to Correia, et al. Specifically, the '873 Patent teaches the use of a connector that is slightly smaller cross-section than the cross-section of the recess in the blocks into which it is inserted to ensure that the connectors cause no interference with the stacking of the blocks on top of one another.

The present invention is distinguishable over the '873 Patent in that the connector clips disclosed herein have a cross-sectional size that is either the same or slightly larger than the recesses in the construction blocks into which the connectors are inserted. This works to provide a greater retention of the clip into the recess and allows for tolerances in the size of the slot in the construction block when manufactured. The plastic and flexible nature of the connector coupled with its slightly oversized cross-section works to correct minor misalignment of blocks, accommodates manufacturing tolerances of the recess in the construction blocks and does not work to interfere with the stacking of the blocks on top of one another.

BRIEF SUMMARY OF INVENTION

The present invention discloses a connector clip used in the securing and alignment of construction blocks stacked on top of one another in various ways and configurations. The connector clip is disclosed. The connector clip of the present invention is generally rectangular in shape with tapered vertical walls with grippers inserted. The connector clip is either the same size or slightly larger than the receiving recess in the construction blocks to make an interference fit between the connector clip and the construction block recess and/or to accommodate for manufacturing tolerances in the recess in the construction blocks. Further, the connector clip is made from a pliable material including but not limited to certain plastics, rubber and/or elastomers.

Further, the present invention discloses an anchoring/alignment system comprised of the connector clips and the construction blocks with receiving recesses is disclosed. The connector clip disclosed above is designed to be a fixed length and inserted into the receiving channels in the construction block along the wall that is being constructed as shown in the attached drawings. Again, the connector clips are the same size or slightly larger than construction block recessed channels and are made of pliable materials like plastic to provide an interference fit between the connector clip and the construction block without interfering with the stacking alignment of the construction blocks.

Lastly, a method of constructing a wall using the connector clips and construction block with inserted receiving recesses is disclosed. Place one construction block on top of two other blocks that have had connector clips set into the recesses in the top portion of these blocks. Position the end of the construction block to insert the connector into the predetermined groove on the bottom of the construction block to the connector below, then lift the other end of the block to insert the block into connector below in the second block. These connectors must remain partially visible in order to fit into the adjacent blocks. The top of each block is identified by a number imprint on top of each block.

There are two or three receiving recesses on the top and bottom of each block. Specifically, there is a receiving recess located in the center and at least one receiving recess toward the front and/or the back of the blocks. The center receiving recess is in the same position on the top and the bottom of the block. The front and back receiving recesses are slightly offset from the top to the bottom of the blocks. In this way, if a set-back wall is desired, all that need be done is line up the front or back receiving recesses from one block to the next as the wall is assembled, vertically.

The connector clips are inserted into these receiving recesses. Before fitting the connectors, it must be determined whether the blocks are to be installed to create a setback wall or a vertical wall. If the connector clip is fitted into the receiving recess located in the center of the block that is continued with the blocks that are fitted over and next to that block, the wall will be vertical. If the connector clip is fitted into the receiving recess located at the front or the rear of the blocks and that is continued, the wall will be set back as it rises vertically.

DRAWINGS

FIG. 1. is an isometric drawing of the present invention.

Figure 2:
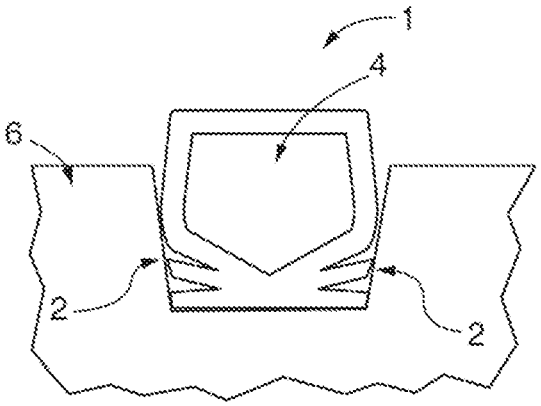

FIG. 2. is a front view of the present invention showing the fit into a construction block.

Figure 2A:
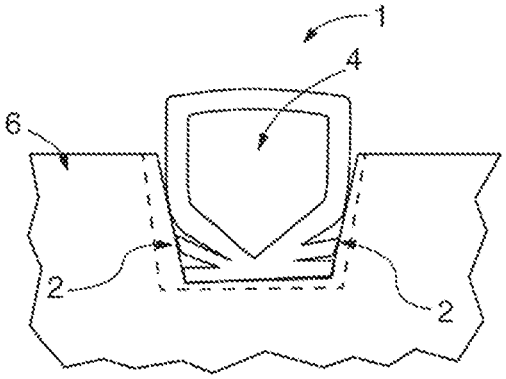

FIG. 2A. is a front view of the present invention showing the fit into a construction block when the slot is slightly undersized and slightly out of location.

Figure 3:
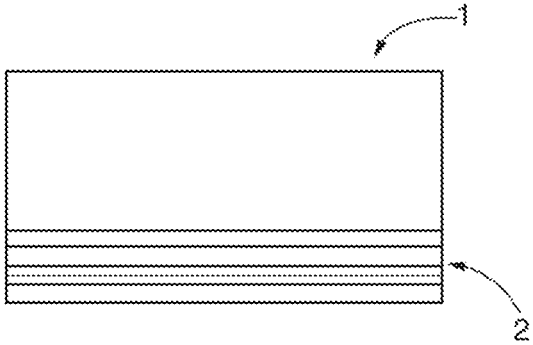

FIG. 3. is a side view of the present invention.

Figure 4:
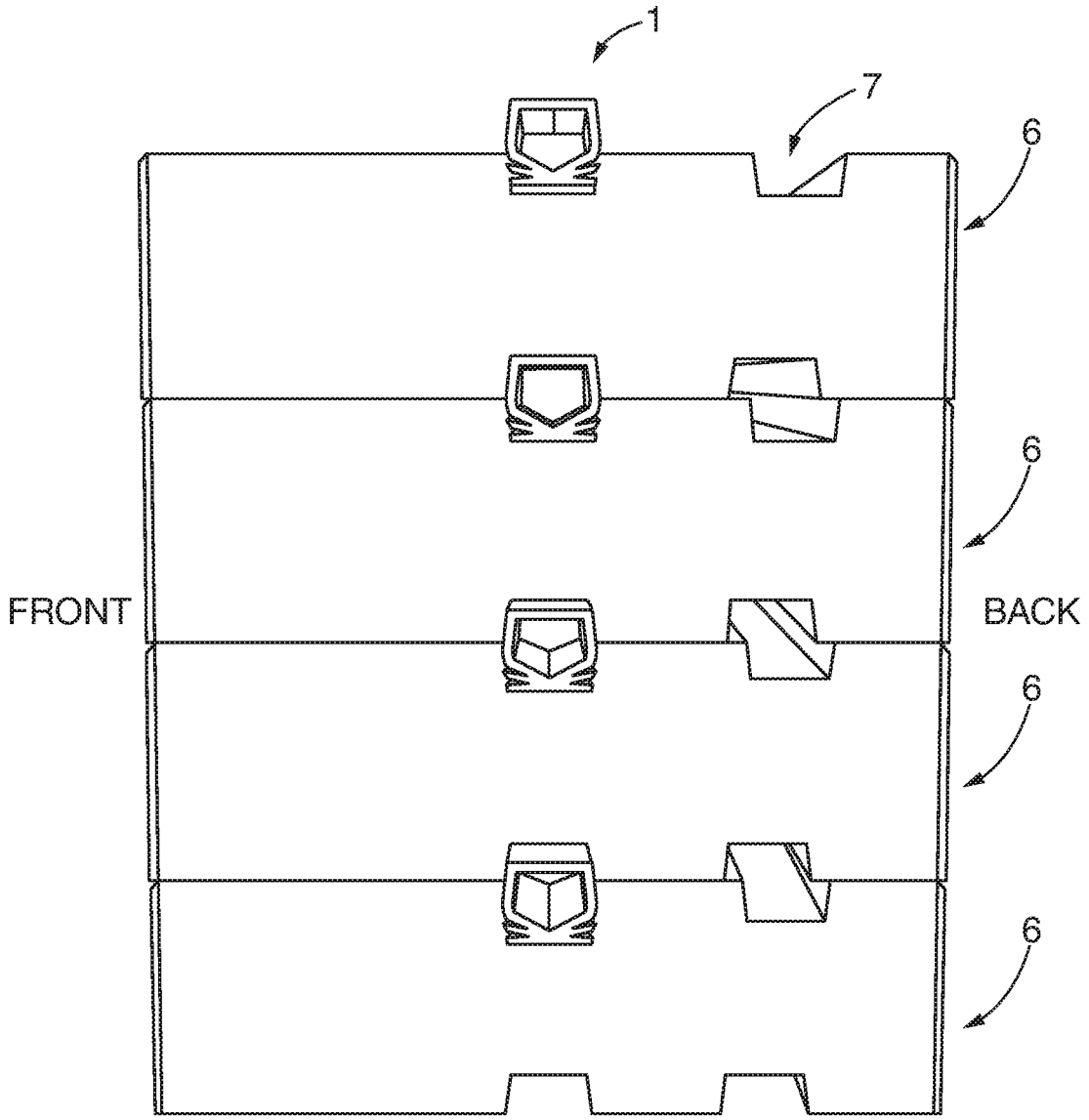
Figure 5:
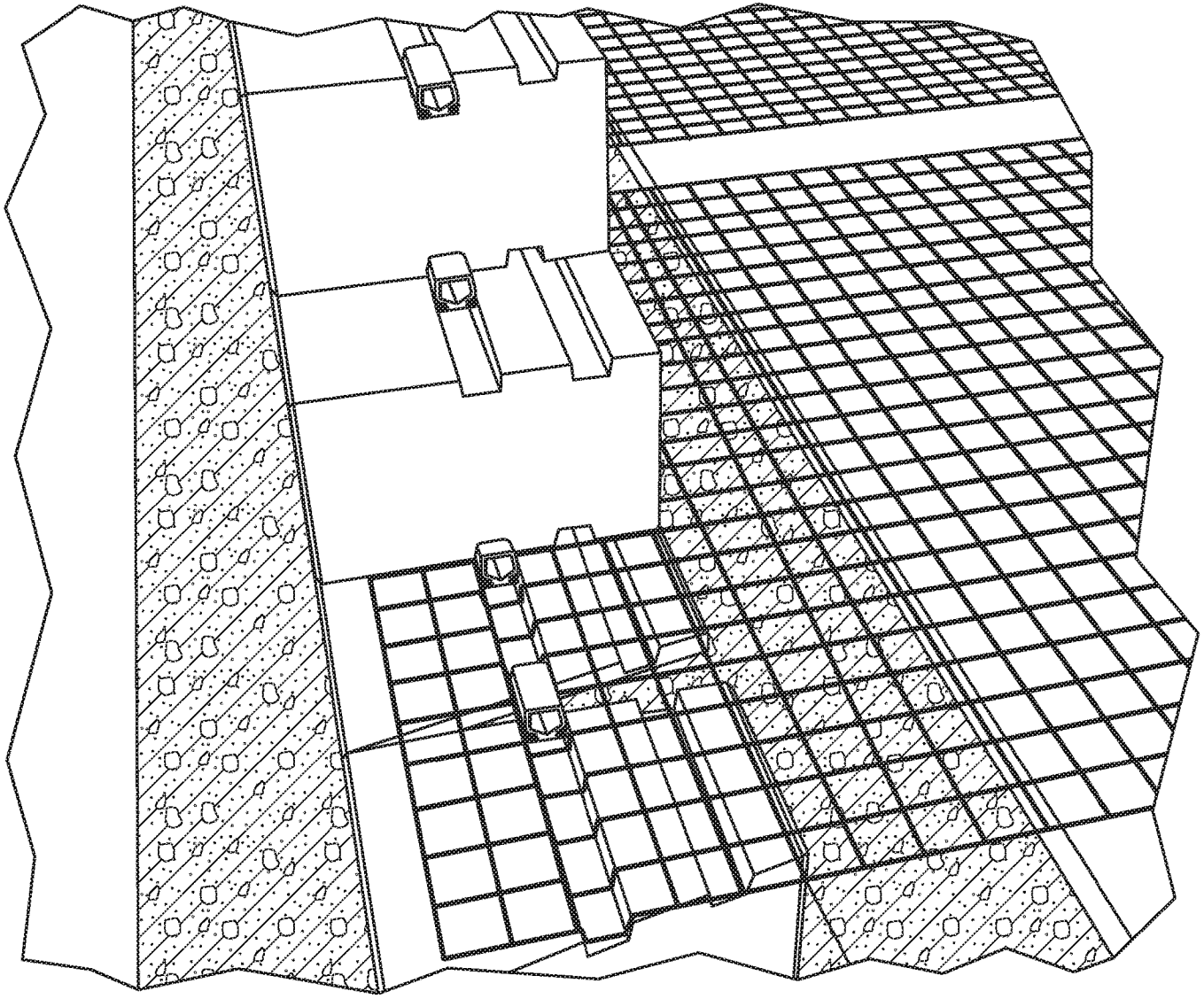

FIG. 4. is a view of the present invention inserted into a series of assembled blocks creating a vertical stacking of block;

FIG. 5. is a view of the present invention inserted into a series of assembled blocks with geogrid underlayment featuring the alignment between construction blocks for a vertical retaining wall.

Figure 6:
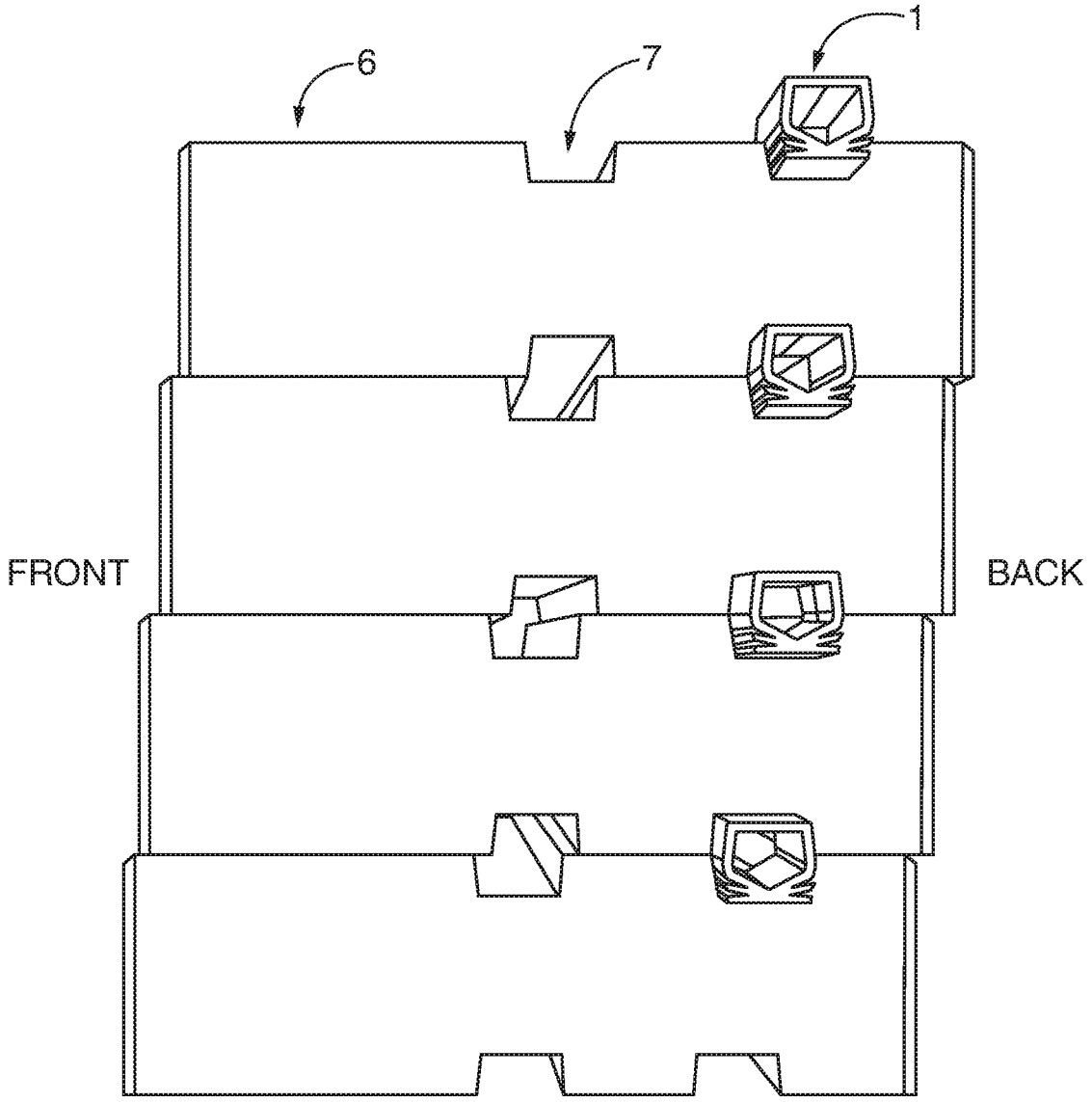

FIG. 6. is a view of the present invention inserted into a series of assembled blocks featuring a set-back stacking of blocks.

Figure 7:
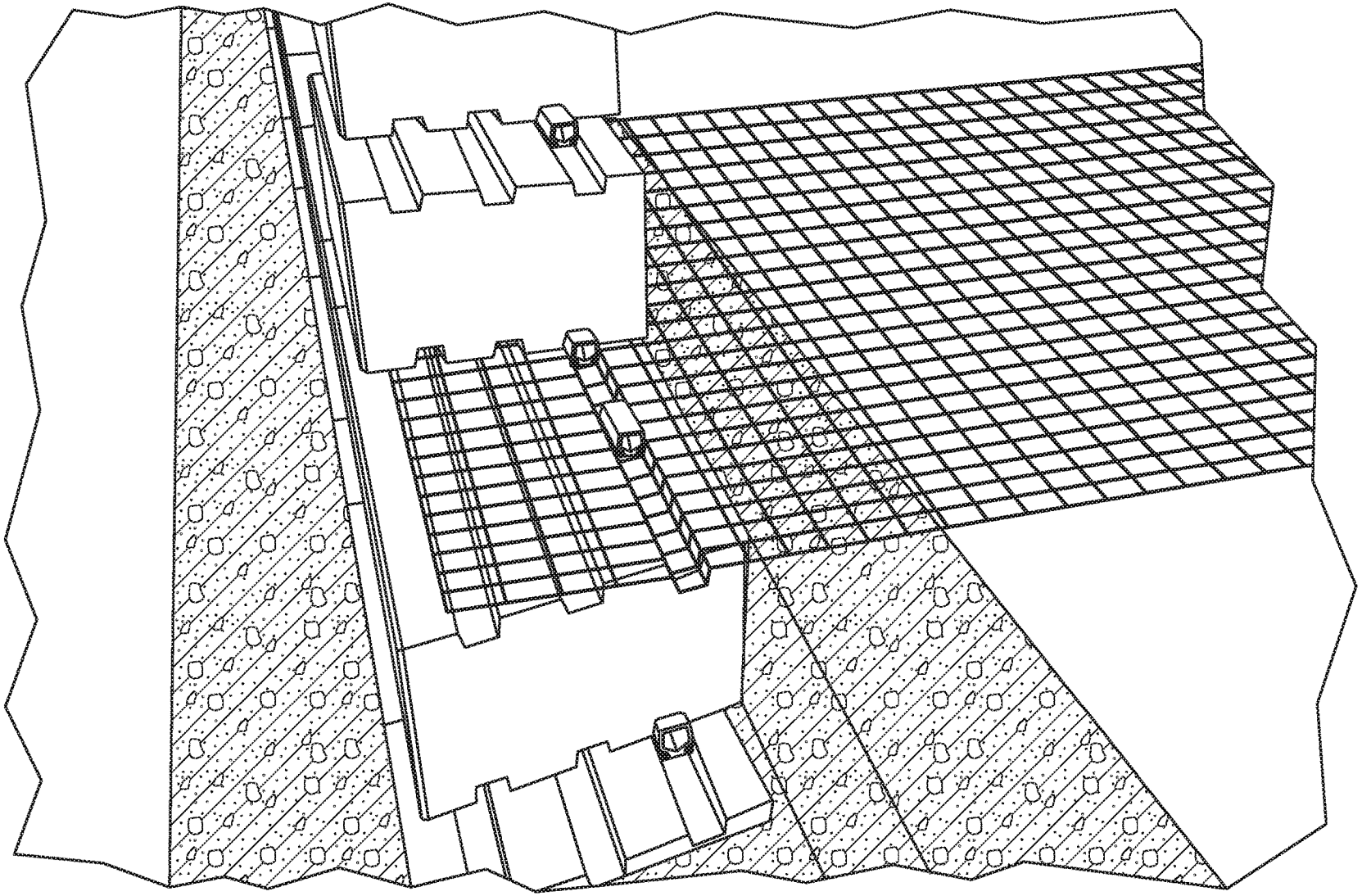

FIG. 7. is a view of the present invention inserted into a series of blocks with a geogrid underlayment featuring the alignment between construction blocks for a set-back retaining wall.

Figure 8:
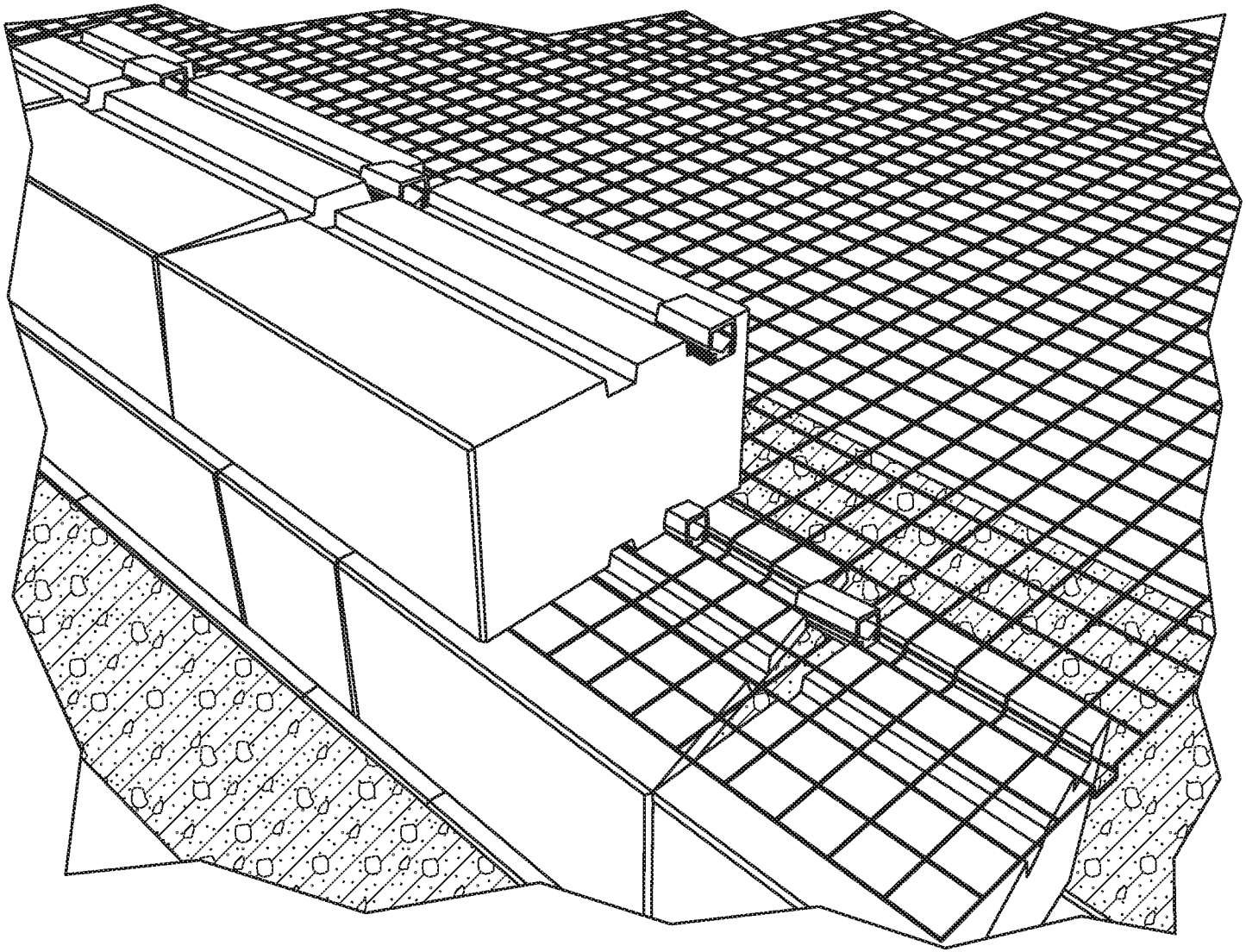

FIG. 8. is a view of the present invention inserted into a series of blocks with a geo-grid underlayment featuring the alignment between construction blocks.

Figure 9:
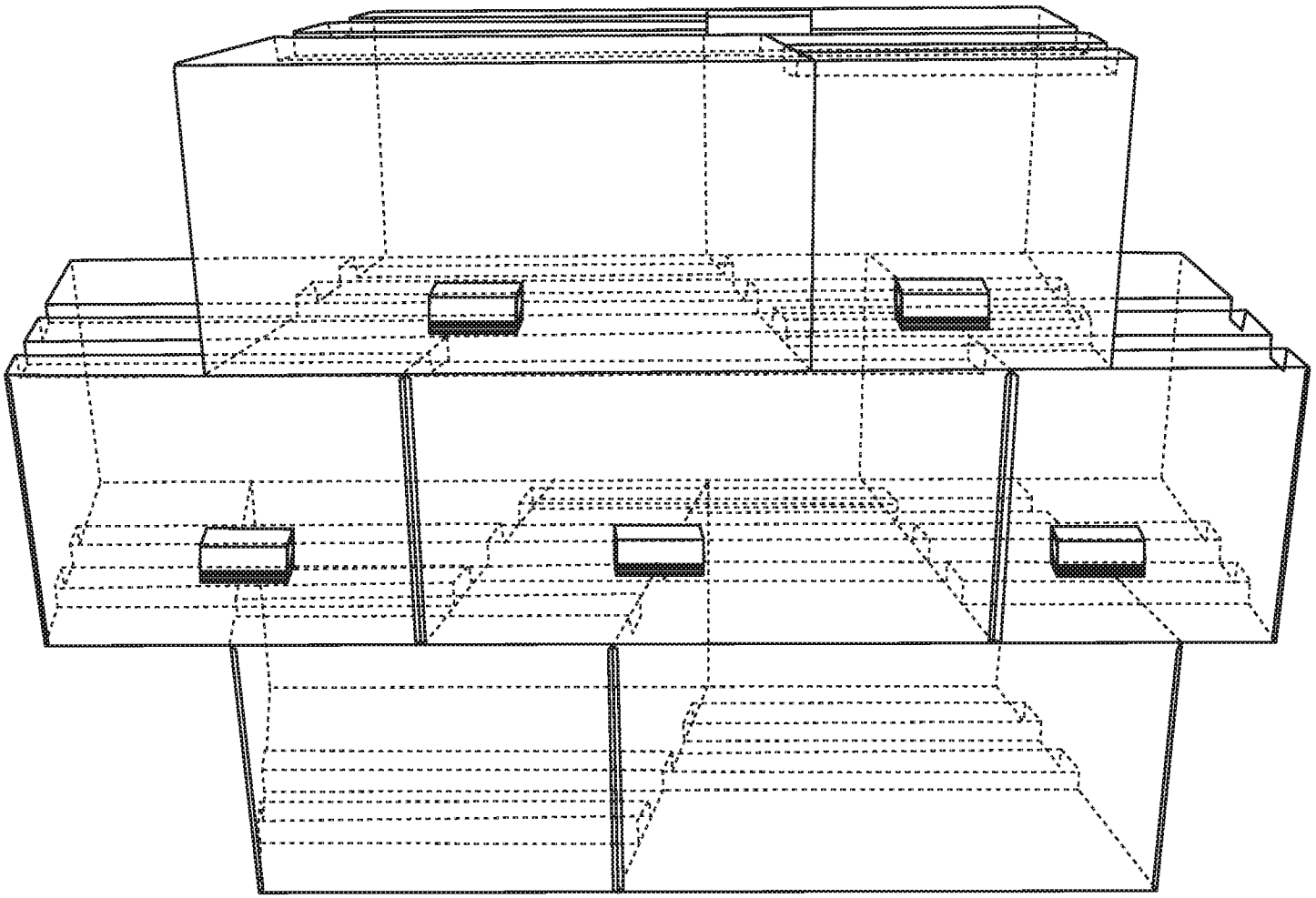

FIG. 9. Is a view of the present invention showing the locking feature between the construction blocks.

DETAILED DESCRIPTION OF INVENTION

The present invention will now be described in terms of the presently preferred embodiment thereof as illustrated in the drawings. Those of ordinary skill in the art will recognize that may obvious modifications may be made thereto without departing from the spirit or scope of the present invention.

The connector clip (1) of the present invention is generally rectangular in shape with an optional hollow cavity internal section (4). The connector clip (1) has side walls that are slightly tapered up on the top half and down on the bottom half of the connector clip (1). FIG. 2. Further, the bottom portion of the connector clip has grippers or slats cut out of the bottom portion of the connector clip (2) which work to secure the connector clip into the receiving recess (7) in the construction blocks (6). FIGS. 4,5,6 and 7. The connector clip (1) is either the same size or slightly larger in width and cross-sectional area (FIG. 2) than the receiving recess (7) in the construction block (6) to provide for a slight press fit and to allow for the variations in tolerance in the size of the receiving recess (7) in the construction block (6). FIG. 2A.

The connector clip (1) is made from any semi-rigid pliable material including but not limited to plastic, rubber and/or elastomers. One preferred embodiment of the present invention is made from thermoplastic polymer. The material and shape of the connector clip must be rigid enough to hold the construction block (6) in place, yet pliable enough to allow for variations in the tolerance in the size of the receiving recess (7) in the construction block (6) and minor misalignment of the location of the receiving recess (7) between mating construction blocks (6). FIG. 7.

If a more rigid material is used for the connector clip (1), a hollow cavity internal section (4) will provide greater pliability and the connector clip (1) can feature such a hollow cavity section (4). Alternatively, if a less rigid material is used for the connector clip (1), a solid or smaller hollow cavity section (4) will provide the necessary rigidity and the connector clip (1) can feature such a hollow cavity section (4).

The present invention also includes a system and method for erecting a construction block wall using construction blocks (6) with receiving recesses (7) the same size or slightly smaller than the connector clips (1) inserted into these receiving recesses. FIG. 2, FIG. 2A and FIG. 4. The first course of construction block (6) is set on a foundation. FIG. 7. The connector clips are set into the receiving recesses (7) exposed on the top side of the construction block (6) set on the foundation. FIG. 7 and FIG. 8. Optionally, geogrid—a geosynthetic material used to transfer the reaction force of the structure erected with the construction block back onto a large area of soil being retained by the structure can be set into the receiving recess (7) of the construction block (6) before the connector clip (1) is inserted into the receiving recess (7). FIG. 7 and FIG. 8. In this last configuration, the connector clips (1) not only work to align and secure the construction block—one to the other—but also work to secure the geogrid mesh material to the structure comprised of the construction blocks. FIG. 7 and FIG. 8.

The connector clips (1) are used to align and secure the construction blocks (6) as they are stacked on top of one another vertically as well as laid side to side horizontally. FIG. 6 and FIG. 7. The purpose served by the connector clips (1) is two-fold in that the system of connector clips (1) inserted into the receiving recesses (7) of the construction blocks (6) serves as a locking mechanism as well as an alignment mechanism from block-to-block. Specifically, the connector clips (1) can be used in a double-sided free-standing wall application. See, FIG. 5. In this arrangement, the connector clips (1) are inserted into the receiving recesses (7) on the top face of the construction blocks (6) located in the center of the construction block on the bottom course of construction blocks. FIG. 5. The course of construction blocks (6) set on top of this bottom course is attached to the connector clips (1) already inserted into the bottom course through the receiving recesses (7) on the bottom face and center location of the construction blocks (6). FIG. 5. In this way, the assembled construction blocks (6) provide a positive interlock to all of the construction blocks on the wall. FIG. 9. The connector clips (1) work not only for horizontal alignment of construction blocks (6) forming the wall, but also to create a positive interlock between the construction blocks and to align the construction blocks vertically to concentrate the weight of the construction bocks making up the wall one on top of the other to avoid any off-set loading by misaligned blocks. See, FIG. 9.

The receiving recesses (7) in the construction block (6) are located on the top face and bottom face of the construction blocks (6). See, FIG. 5. The recess (7) located in the center of the block in the top face is in the same location as the recess located on the bottom face of the construction block (6). See, FIG. 5. However, the recesses toward the back face and/or the front face of the construction block (6) (FIG. 6) on the top and bottom faces of the block (6) are staggered such that the recess located on the bottom face of the block is forward of the recess located on the top face of the block (6). FIG. 5. In this way, when the connector clips (1) are set into the recesses (7) toward the back face and/or front face of the construction blocks (6) and the construction blocks are vertically assembled with the back face or front face recesses lined-up, the resulting wall will be setback. FIG. 7.

Those of ordinary skill in the art will recognize that the embodiments just described merely illustrate the principles of the present invention. Many obvious modifications may be made thereto without departing from the spirit or scope of the invention as set forth in the appended claims.

The invention claimed is:

1. A method for constructing a vertical structure with construction blocks having communicating receiving recesses comprising connector clips being elongate generally rectangular members with a top face, bottom face and side walls; each side wall having a top portion and bottom portion divided at a center point of the side wall; each side wall bottom portion comprising a plurality of grippers, wherein the rectangular member comprises a hollow pentangular cavity section; and wherein each gripper from the plurality of grippers is continuous along a length of the connector clips; the distance between the center point of each side wall is equal to or slightly larger than the width of the communicating receiving recesses in the construction blocks into which it is to be inserted:

placing construction blocks with communicating receiving recesses on a base surface forming a foundation for a structure to be made from the construction blocks;

inserting the connector clips into the communicating receiving recesses in the construction blocks such that a portion of the connector clip sticks up out of the communicating receiving recesses in the construction blocks;

placing construction blocks with communicating receiving recesses side-by-side with the connector clips inserted into the communicating receiving recess of one block and partially sticking out into the communicating receiving recess in an adjacent construction block;

placing construction blocks with communicating receiving recesses on top of the construction blocks already in place with the connector clip portion sticking out of the communicating receiving recesses;

inserting a center located connector clip portion sticking out of the blocks already in place into the communicating receiving recesses of the construction blocks being placed on top of the construction blocks already in place;

continuing until the desired height and width of the vertical structure being made from the construction blocks is achieved.

2. The method of claim 1, wherein the connector clip side wall top portion having each side wall inclined from the center point toward the top face and the side wall bottom portion having each side wall inclined from the center point toward the bottom face.

3. The method of claim 1, wherein geogrid is inserted into the communicating receiving recesses in the construction blocks before the connector clip is inserted.

4. The method of claim 2, wherein geogrid is inserted into the communicating receiving recesses in the construction blocks before the connector clip is inserted.

5. A method for constructing a setback structure with construction blocks having communicating receiving recesses comprising connector clips being elongate generally rectangular members with a top face, bottom face and side walls;

each side wall having a top portion and bottom portion divided at a center point of the side walls;

each side wall having a top portion and bottom portion divided at the center point of the side wall; each side wall bottom portion comprising a plurality of grippers, wherein each gripper from the plurality of grippers is continuous along a length of the connector clips;

wherein the rectangular member comprises a hollow pentangular cavity section; and wherein a distance between the center point of each side wall is equal to or slightly larger than the width of the communicating receiving recesses in the construction blocks into which it is to be inserted:

placing construction blocks with communicating receiving recesses on a base surface forming a foundation for a structure to be made from the construction blocks;

inserting the connector clips into the communicating receiving recesses in the top face of the construction blocks located toward the back or the front of the block such that a portion of the connector clip sticks up out of the receiving recesses in the top face of the construction blocks;

placing construction blocks with communicating receiving recesses side-by-side with the connector clip inserted into the communicating receiving recesses of one block and partially sticking out into the communicating receiving recesses in an adjacent construction block;

placing construction blocks with communicating receiving recesses in the bottom face of the construction block located toward the back or the front of the blocks which are offset from the communicating receiving recesses in the top face of the construction blocks located toward the back or the front of the block such that the wall generated by the alignment of these top face and bottom face communicating receiving recesses located in the front or the back of the block is offset and goes up in a stepped back fashion;

inserting the connector clip portion sticking out of the top face rear or front location of the construction blocks already in place into communicating dots receiving recesses in the bottom face rear or front location of the construction blocks being placed on top of the construction blocks already in place; and continuing these steps until the desired height and width of the set back structure being made from the construction blocks is achieved.

6. The method of claim 5, wherein the connector clip side wall top portion having each side wall inclined from the center point toward the top face and the side wall bottom portion having each side wall inclined from the center point toward the bottom face.

7. The method of claim 5, wherein geogrid is inserted into the communicating receiving recesses in the construction blocks before the connector clip is inserted.

8. The method of claim 6, wherein geogrid is inserted into the communicating receiving recesses in the construction blocks before the connector clip is inserted.

* * * * *